US006477883B2

(12) United States Patent
Liu

(10) Patent No.: US 6,477,883 B2
(45) Date of Patent: Nov. 12, 2002

(54) DIE BLOCK APPARATUS FOR SHAPING WORKPIECES

(75) Inventor: Yao-Tser Liu, Tao-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/738,692

(22) Filed: Dec. 15, 2000

(65) Prior Publication Data

US 2002/0033038 A1 Mar. 21, 2002

(30) Foreign Application Priority Data

Sep. 19, 2000 (TW) ..... 89216224 U

(51) Int. Cl.[7] ..... B21J 13/02
(52) U.S. Cl. ..... 72/357; 72/344
(58) Field of Search ..... 72/344, 345, 354.2, 72/395, 402, 452.9, 478, 427, 357

(56) References Cited

U.S. PATENT DOCUMENTS 1,766,098 A * 6/1930 Booth ..... 72/354.2
1,977,163 A * 10/1934 Wilcox ..... 72/427
3,693,399 A * 9/1972 Chirco ..... 72/402
6,189,361 B1 * 2/2001 Seki et al. ..... 72/395

* cited by examiner

*Primary Examiner*—Lowell A. Larson
(74) *Attorney, Agent, or Firm*—WeiTe Chung

(57) ABSTRACT

A die block apparatus for shaping workpieces by way of die stamping includes a die block (40), a first sliding block (10), a second sliding block (30), and a stopper block (50). The die block is dimensioned to receive the first and second sliding blocks and the stopper block. The first sliding block includes a body (11), a pair of inclined rails (16) extending from opposite lateral sides of the body, and a protrusion (17) extending outwardly from the body. The body has a vertical inner surface (12). A groove (14) is defined in the inner surface. The protrusion has a vertical outer surface (18). The second sliding block is a mirror image of the first sliding block. The stopper block includes a base (54) and a vertical beam (52). The stopper block has a vertical contact surface (56), for abutting the outer surface of the first sliding block.

19 Claims, 6 Drawing Sheets

DIE BLOCK APPARATUS FOR SHAPING WORKPIECES

BACKGROUND OF THE INVENTION

1. Field of the Invention

The present invention relates to a die block apparatus, and particularly to a die block apparatus used for shaping workpieces by way of die stamping.

2. Related Art

With rapid developments in manufacturing industry, the demand for precision components is constantly increasing. Industrial dies need to produce more and more precise components.

A conventional die block apparatus for shaping workpieces by way of die stamping is disclosed in FIG. 5. A die block 86 includes a stamping hole 88, and four piston holes 94 arranged around the periphery of the stamping hole 88. Each piston hole 94 accommodates a pusher pad 90 and a spring 92 thereunder. A die 80 is moved downwardly to act on a workpiece 82. A formed portion 84 of the workpiece 82 is thus created. Simultaneously, the pusher pads 90 compress the springs 92. When the die 80 is withdrawn, the springs 92 decompress to cause the pusher pads 90 to move upwardly. The pusher pads 90 force the workpiece 82 upwardly, thereby releasing the formed portion 84 from the die block 86.

However, the piston holes 94 must be arranged in the immediate vicinity of the stamping hole 88. Consequently, this type of apparatus is not suitable for certain kinds of workpieces. FIG. 6 shows an example of a workpiece 96 which requires a flanged hole 97 near three edges of a portion A of the workpiece 96. The flanged hole 97 has a diameter of, say, 3.5 mm. Only a single pusher pad 90 can be arranged under portion A, inwardly from the hole 97. During unloading, the pusher pad 90 forces the workpiece 96 upwardly, but not uniformly. Consequently, the workpiece 90 frequently sustains damage and distortion. This lowers the precision of the finished workpiece 96.

Therefore, another type of die block apparatus has been developed. The apparatus has a pusher pad directly under the stamping hole, which ensures that the pusher pad forces a workpiece uniformly upwardly. However, the diameter of the pusher pad must fit to the diameter of the stamping hole. When the diameter of the stamping hole is very small, as shown in FIG. 6, the pusher pad is easily damaged.

SUMMARY OF THE INVENTION

Accordingly, an object of the present invention is to provide a die block apparatus for shaping workpieces which ensures the precision of the workpieces.

Another object of the present invention is to provide a die block apparatus for shaping workpieces which readily unloads the workpieces.

A further object of the present invention is to provide a die block apparatus for shaping workpieces which easily forms various kinds of workpieces.

To achieve the above-mentioned objects, a die block apparatus for shaping workpieces by way of die stamping in accordance with the present invention comprises a die block, a first sliding block, a second sliding block and a stopper block. The die block is dimensioned to receive the first and second sliding blocks and the stopper block. The first sliding block comprises a body, a pair of inclined rails extending from opposite lateral sides of the body, and a protrusion extending outwardly from the body. The body has a vertical inner surface. A groove is defined in the inner surface. The protrusion has a vertical outer surface. The second sliding block is a mirror image of the first sliding block. The stopper block comprises a base and a vertical beam. The stopper block defines a vertical contact surface, for abutting the outer surface of the first sliding block.

Other objects, advantages and novel features of the present invention will be drawn from the following detailed embodiments of the present invention with attached drawings, in which:

DESCRIPTION OF THE PREFERRED EMBODIMENTS

Figure 1:
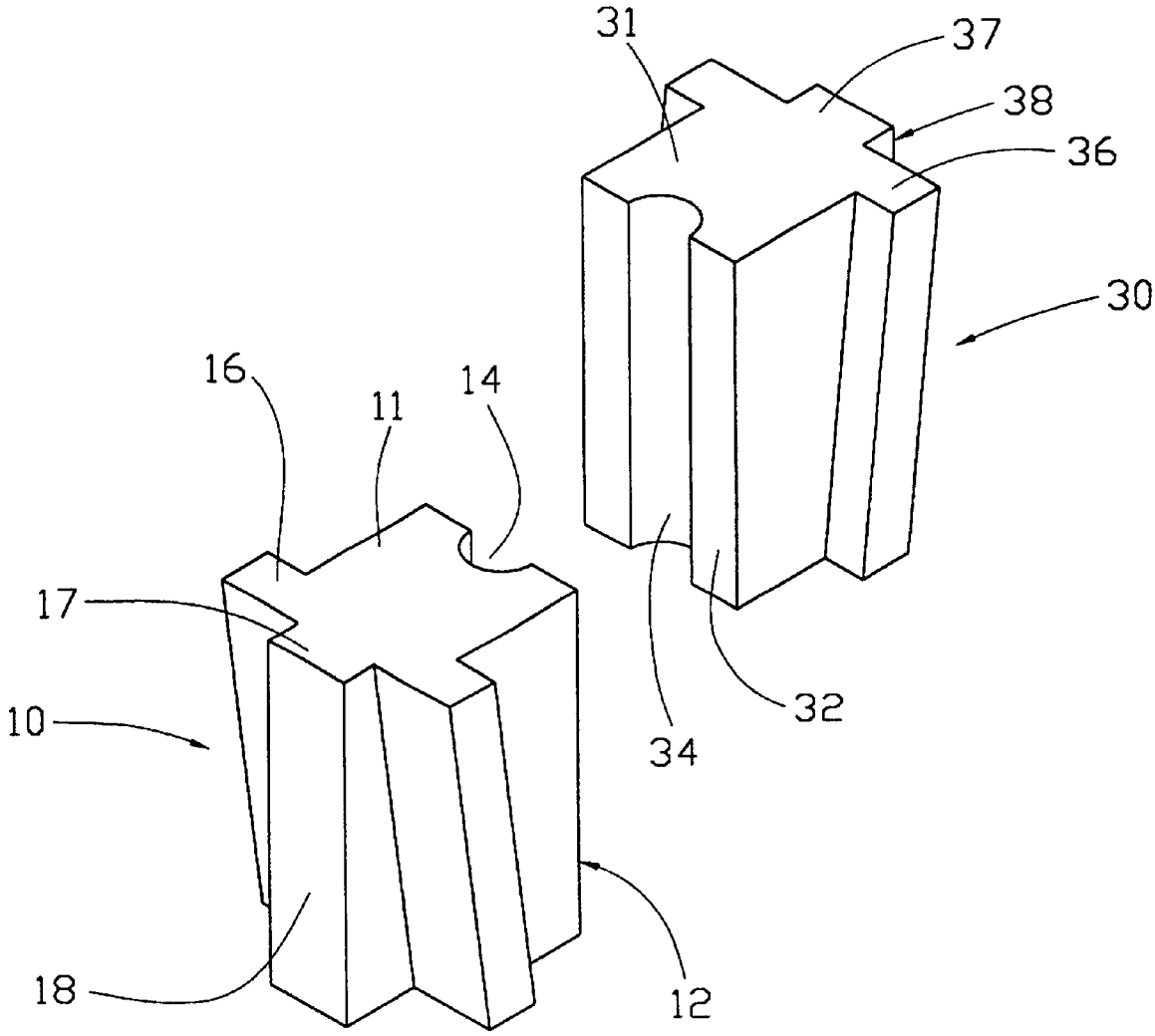
FIG. 1 is an exploded view of first and second sliding blocks of a die block apparatus for shaping workpieces in accordance with a preferred embodiment of the present invention.
Figure 2:
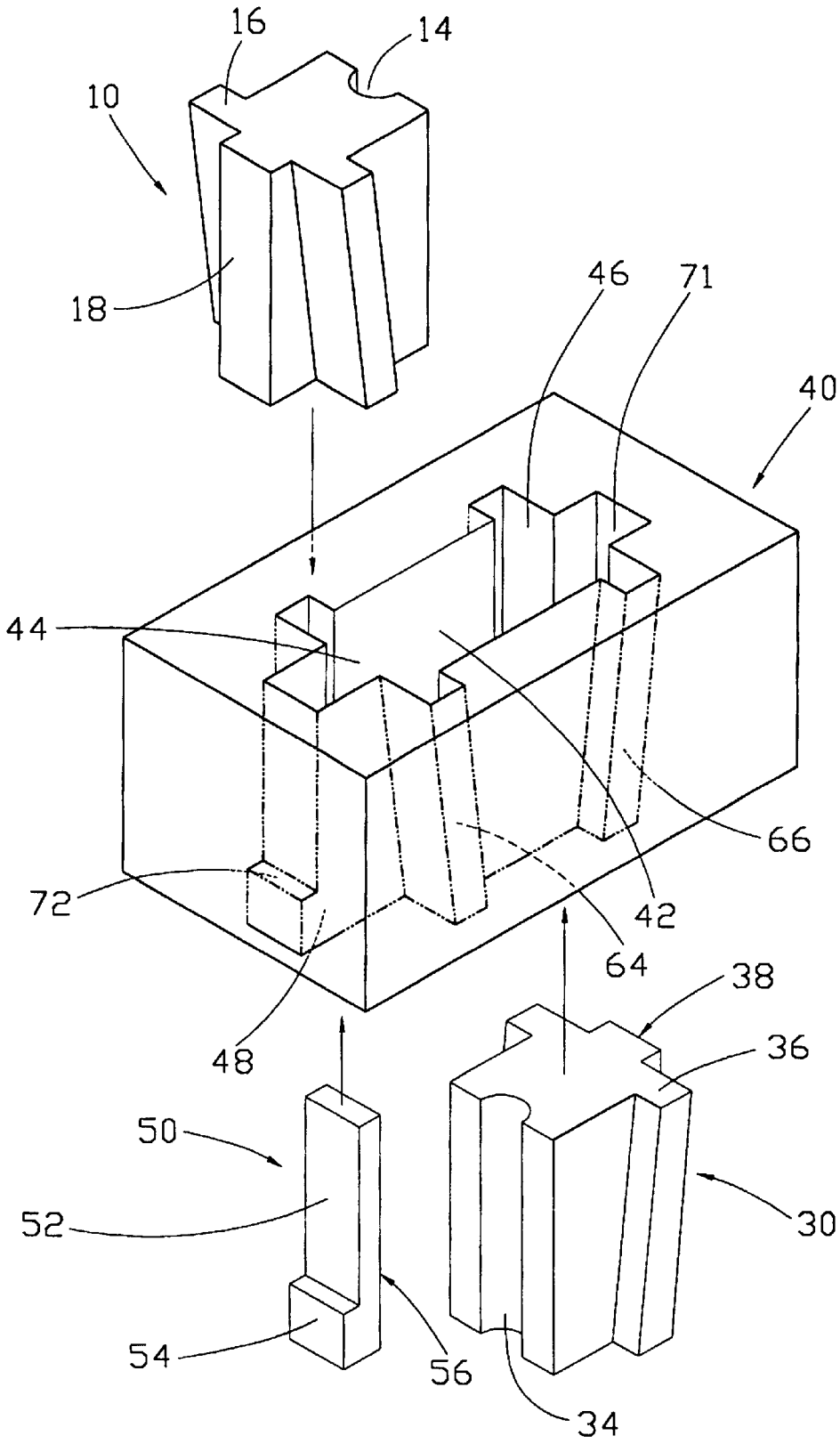
FIG. 2 is an exploded view of the die block apparatus for shaping workpieces in accordance with a preferred embodiment of the present invention.

Referring to FIGS. 1–2, a die block apparatus for shaping workpieces by way of die stamping in accordance with a preferred embodiment of the present invention comprises a die block 40, a first sliding block 10, a second sliding block 30 and a stopper block 50.

The first sliding block 10 has a first body 11 with a vertical first inner surface 12. A semi-cylindrical first groove 14 is defined in the first inner surface 12. A pair of first inclined rails 16 extends from respective opposite lateral sides of the first body 11 at an end thereof opposite the first inner surface 12. A first stopper protrusion 17 extends from the end of the first body 11 opposite the first inner surface 12, between the pair of first inclined rails 16. The first stopper protrusion 17 has a vertical first outer surface 18 parallel to the first inner surface 12 of the first body 11.

The second sliding block 30 is a mirror image of the first sliding block 10. The second sliding block 30 comprises a second body 31, a vertical second inner surface 32, a semi-cylindrical second groove 34, a pair of second inclined rails 36, a second stopper protrusion 37, and a vertical second outer surface 38.

The stopper block 50 comprises a base 54, and a beam 52 extending upwardly from one end of the base 54. Respective coplanar surfaces of the base 54 and beam 52 in combination define a vertical contact surface 56.

The die block 40 defines a central chamber 42 therein. The central chamber 42 comprises a first chamber 44, a second chamber 46 and a third chamber 48 each dimensioned to respectively receive the first sliding block 10, the second sliding block 30 and the stopper block 50. The first chamber 44 is disposed between the second chamber 46 and the third chamber 48. The first chamber 44 is in communication with the second chamber 46 and the third chamber 48 at respective opposite extremities of the first chamber 44. The first chamber 44 comprises a pair of first inclined grooves 64 at respective opposite extremities thereof, corresponding to the first inclined rails 16 of the first sliding block 10. The second chamber 46 is a mirror image of the first chamber 44. The second chamber 46 comprises a pair of second inclined grooves 66 at respective opposite extremities thereof, corresponding to the second inclined rails 36 of the second sliding block 30. As noted, the non-parallel grooves 64 and 66 may be deemed to converge toward each at an imaginary converging point. The die block 40 further comprises an end wall 71 and a shoulder 72. The end wall 71 forms an extremity of the second chamber 46 farthest from the first chamber 44. The shoulder 72 is adjacent the third chamber 48, corresponding to an inmost surface (not labeled) of the base 54 of the stopper block 50.

In assembly, the second sliding block 30 is slid from below the die block 40 along the second inclined grooves 66 into the second chamber 46 of the die block 40. The first sliding block 10 is then slid from above the die block 40 along the first inclined grooves 64 into the first chamber 44 of the die block 40. Finally, the stopper block 50 is slid from below the die block 40 into the third chamber 48 of the die block 40. The base 54 of the stopper block 50 abuts the shoulder 72 of the die block 40. The stopper block 50 is retained in the third chamber 48 by conventional means such as interferential engagement.

In this position, the first and second inner surfaces 12, 32 of the first and second sliding blocks 10, 30 abut each other. The first groove 14 of the first sliding block 10 is in communication with the second groove 34 of the second sliding block 30. Bottom surfaces (not labeled) of the first and second sliding blocks 10, 30 are coplanar. A first clearance (not labeled) exists between the first outer wall 18 of the first sliding block 10 and the vertical contact surface 56 of the stopper block 50, to allow the sliding block 10 to be moved upwardly along the first inclined grooves 64 of the die block 40. Similarly, a second clearance (not labeled) exists between the second outer surface 38 of the second block 30 and the end wall 71 of the die block 40, to allow the sliding block 30 to be moved upwardly along the second inclined grooves 66 of the die block 40. The first and second clearances (not labeled) are identical.

Figure 3:
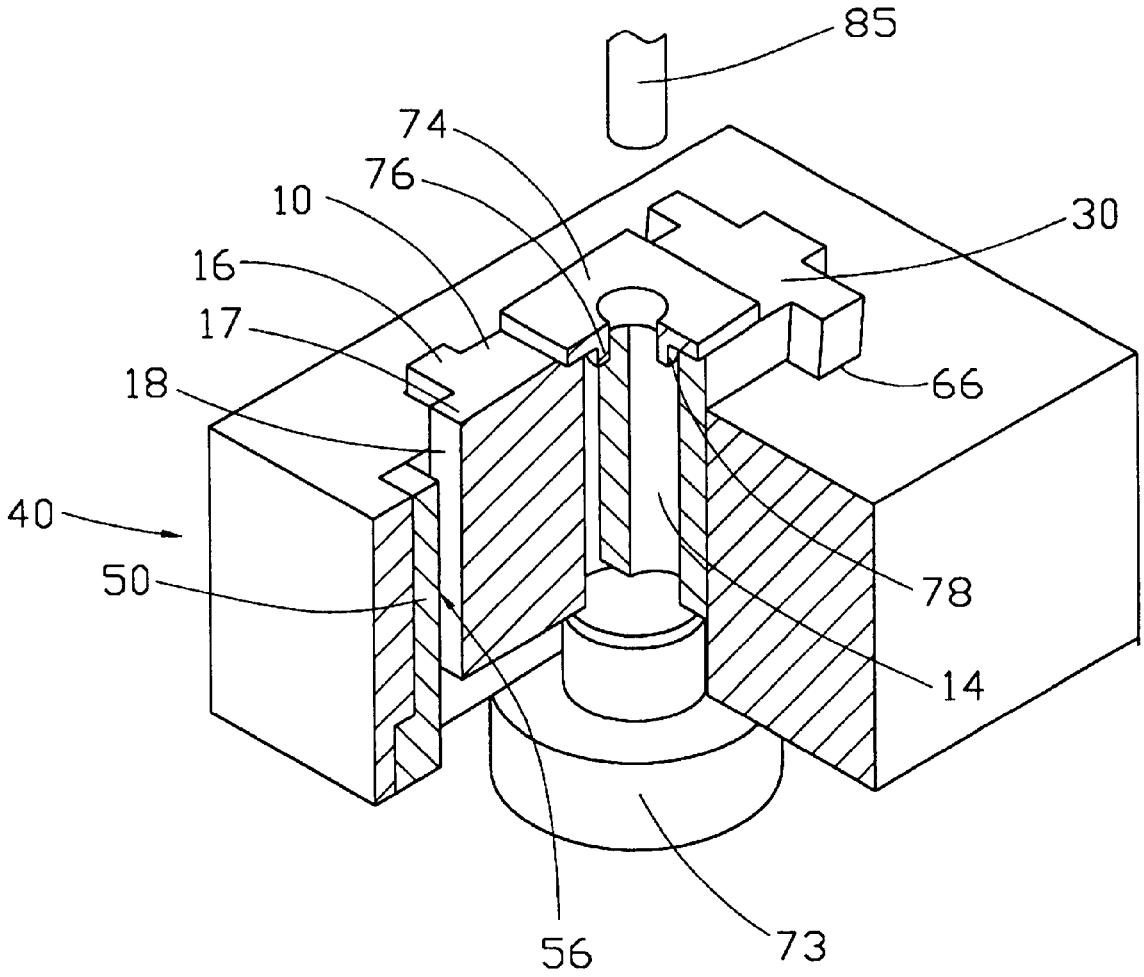
FIG. 3 is a cut-away assembled view of FIG. 2, also showing other components used in the process of die stamping and unloading a workpiece.

Referring to FIG. 3, in operation, a stamping process involves a die 85 acting on a workpiece 74. A formed portion 76 of the workpiece 74 is created. The formed portion 76 has an external peripheral surface 78. The surface 78 closely abuts the first and second sliding blocks 10, 30 at the grooves 14, 34 respectively. At this stage, the first and second sliding blocks 10, 30 are defined to be in a first position.

In the unloading operation, the first and second sliding blocks 10, 30 are moved upwardly by a pusher pad 73. As the first and second sliding blocks 10, 30 move upwardly along the inclined grooves 64, 66 respectively, they are forced to be progressively displaced horizontally in mutually opposite directions. Accordingly, the first and second sliding blocks 10, 30 separate from the peripheral surface 78 of the workpiece 74. The first and second sliding blocks 10, 30 are continued to be so moved until the first outer surface 18 of the first sliding block 10 abuts the contact surface 56 of the stopper block 50 and the second outer surface 38 of the second sliding block 30 abuts the end wall 71 of the die block 40. Thus further movement of the first and second sliding blocks 10, 30 is stopped. The workpiece 74 is released from the first and second sliding blocks 10, 30, and is free to be removed from the apparatus. At this stage, the first and second sliding blocks 10, 30 are defined to be in a second position.

Figure 4:
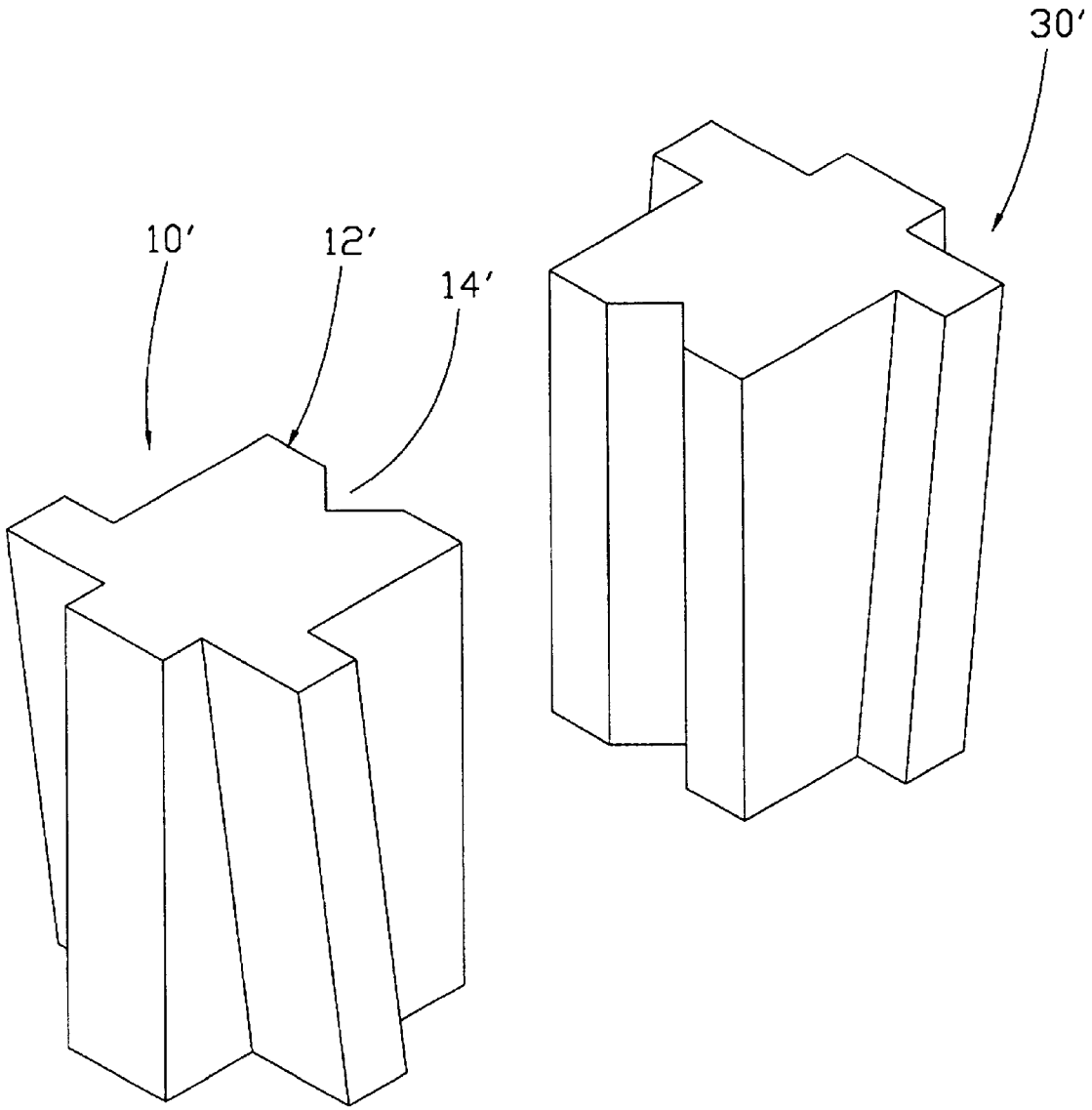
FIG. 4 is an exploded view of first and second sliding blocks of a die block apparatus for shaping workpieces in accordance with an alternative embodiment of the present invention.
Figure 5:
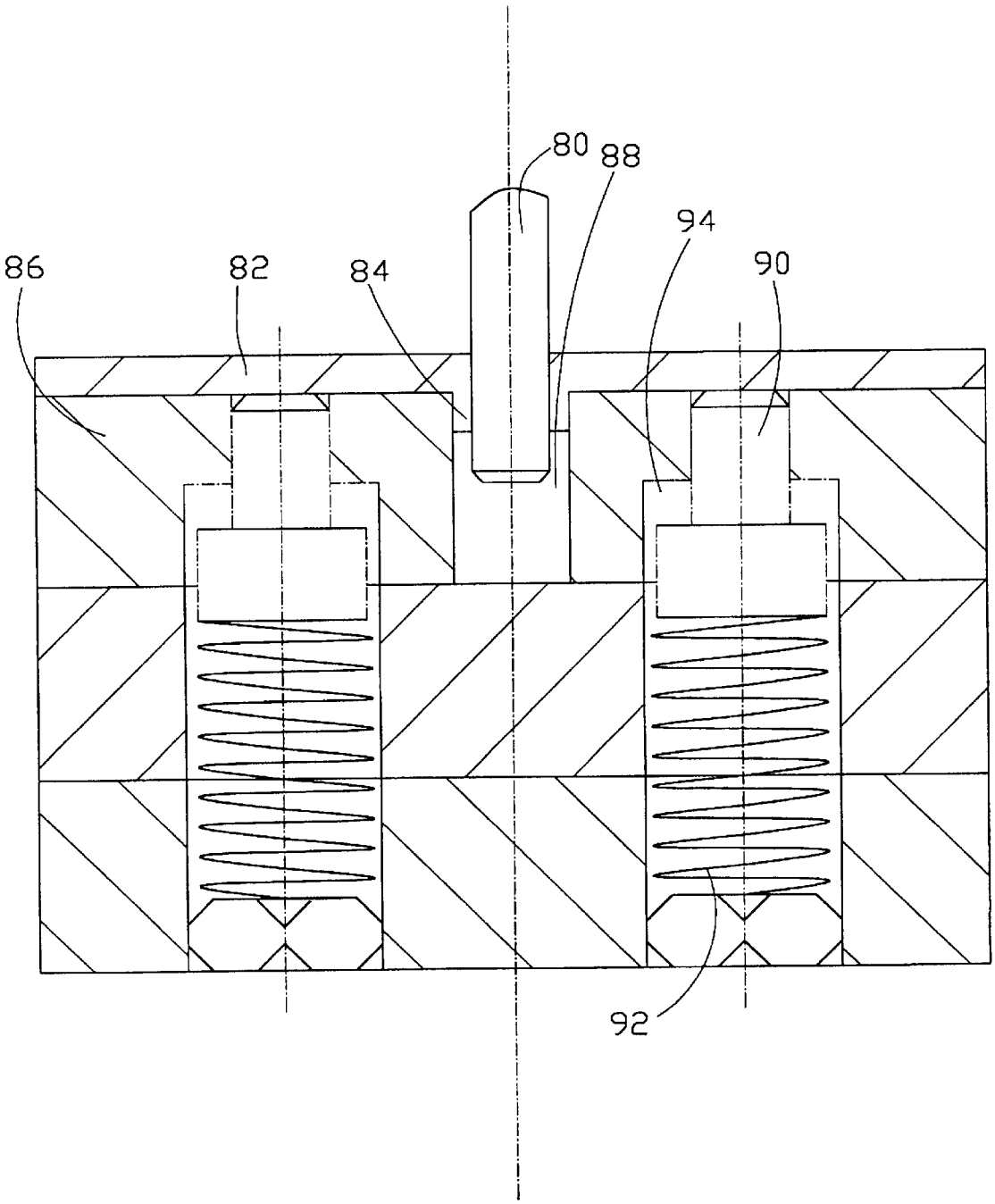
FIG. 5 (PRIOR ART)
FIG. 5 is a cross-sectional view of a conventional apparatus for shaping workpieces, together with other conventional components used in the process of die stamping and unloading a workpiece.
Figure 6:
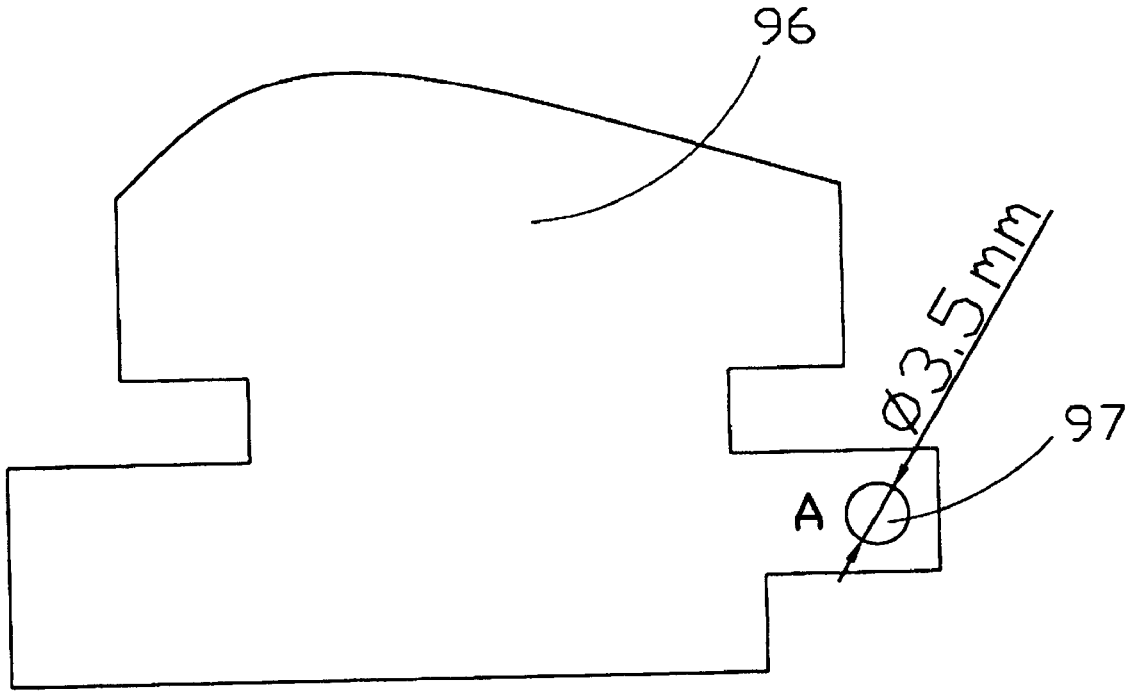
FIG. 6 is a top plan view of an example workpiece.

FIG. 4 shows a pair of sliding blocks 10', 30' in accordance with an alternative embodiment of the present invention. The sliding block 10' is similar to the first sliding block 10. The sliding block 10' has a vertical inner surface 12'. A groove 14' is defined in the inner surface 12'. The groove 14' is triangular in cross-section. The sliding block 30' is a mirror image of the sliding block 10'. In assembly, the pair of inner surfaces 12' of the sliding blocks 10', 30' abut each other. The pair of grooves 14' of the sliding blocks 10', 30' are in communication with each other, and together form a space which has a rectangular cross-section.

Similarly, further alternative embodiments of the present invention can allow shaped workpieces of various kinds of to be easily manufactured.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A die block apparatus for shaping workpieces by way of die stamping comprising:

a die block defining a first chamber and a second chamber in communication with the first chamber;

a first sliding block received in the first chamber of the die block, the first sliding block comprising at least one inclined rail for guiding the first sliding block to move with respect to the die block, a stopper protrusion, and a first groove defined in an inner surface of the first sliding block and adapted to create part of a formed portion of a workpiece, the at least one inclined rail located between the stopper protrusion and the inner surface; and a second sliding block received in the second chamber of the die block, the second sliding block comprising at least one inclined rail for guiding the second sliding block to move with respect to the die block, and a second groove communicable with the first groove of the first sliding block to create another part of the formed portion of the workpiece, wherein the first sliding block is movable from a first position at which the stopper protrusion does not abut the die block to a second position at which the stopper protrusion abut the die block.

2. The apparatus as described in claim 1, wherein the die block further defines a third chamber in communication with the first chamber, for facilitating assembly of the first and second sliding blocks.

3. The apparatus as described in claim 2, wherein the apparatus further comprises a stopper block for being received and retained in the third chamber of the die block.

4. The apparatus as described in claim 3, wherein the stopper block has a base, and the die block has a shoulder for abutting the base.

5. The apparatus as described in claim 1, wherein each sliding block comprises a pair of inclined rails at respective opposite lateral sides thereof.

6. The apparatus as described in claim 1, wherein each groove of the sliding blocks has a semi-circular cross-section.

7. The apparatus as described in claim 1, wherein each groove of the sliding blocks has a triangular cross-section.

8. The apparatus as described in claim 1, wherein the sliding blocks diverge when moved from the first position to the second position.

9. A die block apparatus comprising:

a die block forming a first chamber and a second chamber both vertically extending through the die block and face to face horizontally communicating with each other in the die block;

a first sliding block slidably received within the first chamber;

means for guiding movement of the first sliding block relative to the die block in both vertical and horizontal directions;

a second sliding block slidably received within the second chamber; and means for guiding movement of the second sliding block relative to the die block in both said vertical and horizontal direction; wherein the first sliding block and the second sliding block moveably converge toward each other into said die block and adapted to leave away from each other when move away from an imaginary converging point of the movements of said first sliding block and said second sliding block, and at least one of said first sliding block and said second sliding block is assembled to said die block in a slanted direction toward said imaginary converging point.

10. The apparatus as described in claim 9, wherein a third chamber is communicatively disposed beside one of said first chamber and said second chamber which receives said at least one of said first sliding block and said second sliding block to allow assembling said at least one of said first sliding block and said second sliding block to said one of said first chamber and said second chamber along said slanted direction without interference.

11. The apparatus as described in claim 10, wherein a stop block is received within said third chamber to confront said at least one of said first sliding block and said second sliding block when said at least one of said first sliding block and said second sliding block leaves away from the other of said first sliding block and said second sliding block.

12. The apparatus as described in claim 10, wherein the first sliding block and said second sliding block are assembled to said die block from two opposite sides of said die block.

13. The apparatus as described in claim 10, wherein said means for guiding movement of the first sliding block relative to the die block in both vertical and horizontal directions, includes inclined rails on the first sliding block and inclined grooves in the die block, said inclined rails and said inclined grooves extending along the same direction.

14. The apparatus as described in claim 10, wherein said means for guiding movement of the second sliding block relative to the die block in both vertical and horizontal directions, includes inclined rails on the second sliding block and inclined grooves in the die block, said inclined rails and said inclined grooves extending along the same directions.

15. A method of assembling a die block apparatus, comprising the steps of:

providing a die block defining a first chamber and a second chamber face to face communicating with each other;

providing a first sliding block slantingly moveably received within the first chamber;

providing a second sliding block slantingly moveably received within the second chamber; and arranging the first sliding block and said second sliding block to be closely face to face confronted each other in a horizontal direction when said first sliding block and said second sliding block are moved into the die block from a same side of the die block, while to be substantially spatially away from each other when said first sliding block and said second sliding block are moved away from the die block to said same side of the die block; wherein said first sliding block and said second sliding block are assembled to said die block from two opposite sides of the die block.

16. The method as described in claim 15, further including providing a third chamber by the first chamber and opposite to said second chamber to receive a stop block therein, when said first sliding block is the one which is assembled to the die block along a direction from a position which is away from the other sliding block, to another position which is close to the other sliding block.

17. A die block apparatus comprising:

a die block defining a first chamber and a second chamber face to face communicating each other;

a first sliding block slantingly moveably received within the first chamber;

a second sliding block slantingly moveably received within the second chamber; and a third chamber additionally communicatively formed by said first chamber for allowing assembling the first sliding block into the first chamber of the die block without interference, wherein the first chamber, second chamber and third chamber all extend in a direction from top-to-bottom.

18. The apparatus as described in claim 17, wherein a stop block is moveably received within the third chamber after said first sliding block has been assembled into the first chamber, the stop block being capable of limiting radial movement of the first sliding block.

19. The apparatus as described in claim 17, wherein the first sliding block is assembled into the first chamber along a direction from a first position where the first sliding block is far away from said second sliding block to a second position where the first sliding block is closer to said second sliding block.

* * * * *